United States Patent [19]

Harloff

[11] Patent Number: 4,913,066

[45] Date of Patent: Apr. 3, 1990

[54] ROTARY COMBUSTOR HAVING A MATERIAL REMOVAL DEVICE

[75] Inventor: Richard R. Harloff, Monroeville, Pa.

[73] Assignee: Westinghouse Electric Corp., Pittsburgh, Pa.

[21] Appl. No.: 339,050

[22] Filed: Apr. 17, 1989

[51] Int. Cl.[4] ..... A47J 36/00; A47J 36/24

[52] U.S. Cl. ..... 110/246; 110/165 R; 110/170

[58] Field of Search ..... 110/170, 246, 226, 165 R

[56] References Cited

U.S. PATENT DOCUMENTS 3,822,651 7/1974 Harris et al. ..... 110/10
3,906,874 9/1975 Jaromko et al. ..... 110/246 X
4,615,283 10/1986 Ciliberti et al. ..... 110/216
4,782,769 11/1988 Lee et al. ..... 110/246
4,840,130 6/1989 Quiel ..... 110/246 X

FOREIGN PATENT DOCUMENTS 0170125 2/1986 European Pat. Off. ..... 110/170
1120058 4/1955 Fed. Rep. of Germany ..... 110/170

*Primary Examiner*—Edward G. Favors

[57] ABSTRACT

A rotary combustor which includes a combustion barrel and a windbox disposed underneath the barrel. A scraper is mounted inside the windbox on a sloping bottom surface thereof which is movable along the surface to remove material therefrom.

7 Claims, 3 Drawing Sheets

ROTARY COMBUSTOR HAVING A MATERIAL REMOVAL DEVICE

BACKGROUND OF THE INVENTION

1. Field of the Invention

The present invention is directed to a rotary combustor useful in a waste disposal system for the combustion of solid waste materials and, more particularly, to an improved rotary combustor having a device for removing material accumulated on a bottom surface of a windbox.

2. Description of the Related Art

Waste disposal systems employing rotary combustors for the combustion of waste materials have long been known. For example, numerous types of waste disposal combustion systems for solid waste materials have been employed for the disposal of municipal waste. Useful types of such waste disposal systems are described in U.S. Pat. Nos. 3,822,651, 4,615,283 and 4,782,769. These types of waste disposal combustion systems utilize a rotary combustor formed by plurality of longitudinally extending pipes secured together to form a cylindrical combustion barrel defining a combustion chamber therein. The pipes are connected together by webs having openings therein for entry of combustion air into the combustion barrel. The pipes are adapted to accommodate the flow of water therethrough to cool the walls of the combustion barrel and produce steam. Air is charged to the combustion barrel through various means such as windboxes and combustion gases from the unit passed to a boiler or furnace for further production of steam. Ash from the combustion material falls out of the outlet end of the combustor into an ash receiving chamber. These types of waste disposal combustion systems have been found very useful in waste disposal while providing revenue through generation of steam and electric power.

While waste disposal systems employing rotary combustors as described above are capable of burning most types of combustible waste, certain problems arise when the waste includes matter such as low melting temperature metals, particularly, those used in beverage containers, foil, disposable trays, etc., which contain aluminum. Aluminum melts at a temperature lower than the operating temperature in the combustion barrel and therefore the aluminum turns into liquid and flows through the combustion air openings in the combustion barrel and down into the windboxes under the barrel. The liquid or molten metal then tends to accumulate on the bottom wall of each windbox where it cools off rapidly due to the cooler temperatures therein and eventually creates a thick sheet of material on the bottom of each windbox. Periodic removal of this layer or sheet is necessary in order to continue efficient operation of the combustor.

One method current used is a manual technique that requires a partial outage of the combustor during removal. During the removal period, the combustor power level is reduced and carbon monoxide (CO) control is stopped. This situation results in a loss of availability and poor emissions control.

Another method which has been developed which does not require a partial outage of the combustor is that described in U.S. Pat. No. 4,782,769 which employs a heated surface at the bottom of the windbox to keep any molten metal such as aluminum in a liquid state wherein it may be drained out of the windbox through a heated pipe. While this method and apparatus has proved useful, a need still exists for other ways of removing material such as aluminum which collects in the bottom of the windboxes while the combustor is still at full power.

SUMMARY OF THE INVENTION

It is an object of the present invention to provide a rotary combustor having means for removing material such as aluminum which collects on the bottom sloping surface of a windbox while still maintaining the combustor at full power.

It is a further object of the present invention to provide a rotary combustor having means for removing resolidified metal such as aluminum from the bottom sloping surface of a windbox whereby the metal is broken up into smaller pieces during removal.

It is another object of the present invention to provide a rotary combustor having a scraper movable along a bottom sloping surface of a windbox to remove resolidifed molten metal such as aluminum therefrom.

The invention achieves the above objects of the invention by providing a rotary combustor which includes a combustion barrel having combustion air openings therein and a windbox disposed underneath the combustion barrel to provide combustion air. The bottom of the windbox has a downwardly and inwardly sloping or slanting surface. A scraper is mounted for movement along the bottom surface to remove any material which collects thereon. Drive means are provided for moving the scraper along the surface comprised of a rotatable shaft threadably engaged with the scraper whereby the rotation of the shaft moves the scraper along the surface. The windbox further has a compartment at the outer end of the bottom surface extending outwardly from a side wall of the windbox to accommodate or store the scraper when it is not in use. In one embodiment of the invention, the bottom surface of the windbox is provided with one or more ridges thereon and the bottom of the scraper is provided with one or more corresponding channels having the same general cross-sectional configuration as the ridges whereby the ridges are accommodated in the channels when the scraper is on the surface.

These, together with other objects and advantages, which will be subsequently apparent, reside in the details of the construction and operation of the invention as more fully described and claimed hereafter, reference being made to the accompanying drawings forming a part hereof wherein like numerals refer to like parts throughout.

DESCRIPTION OF THE PREFERRED EMBODIMENTS

Figure 1:
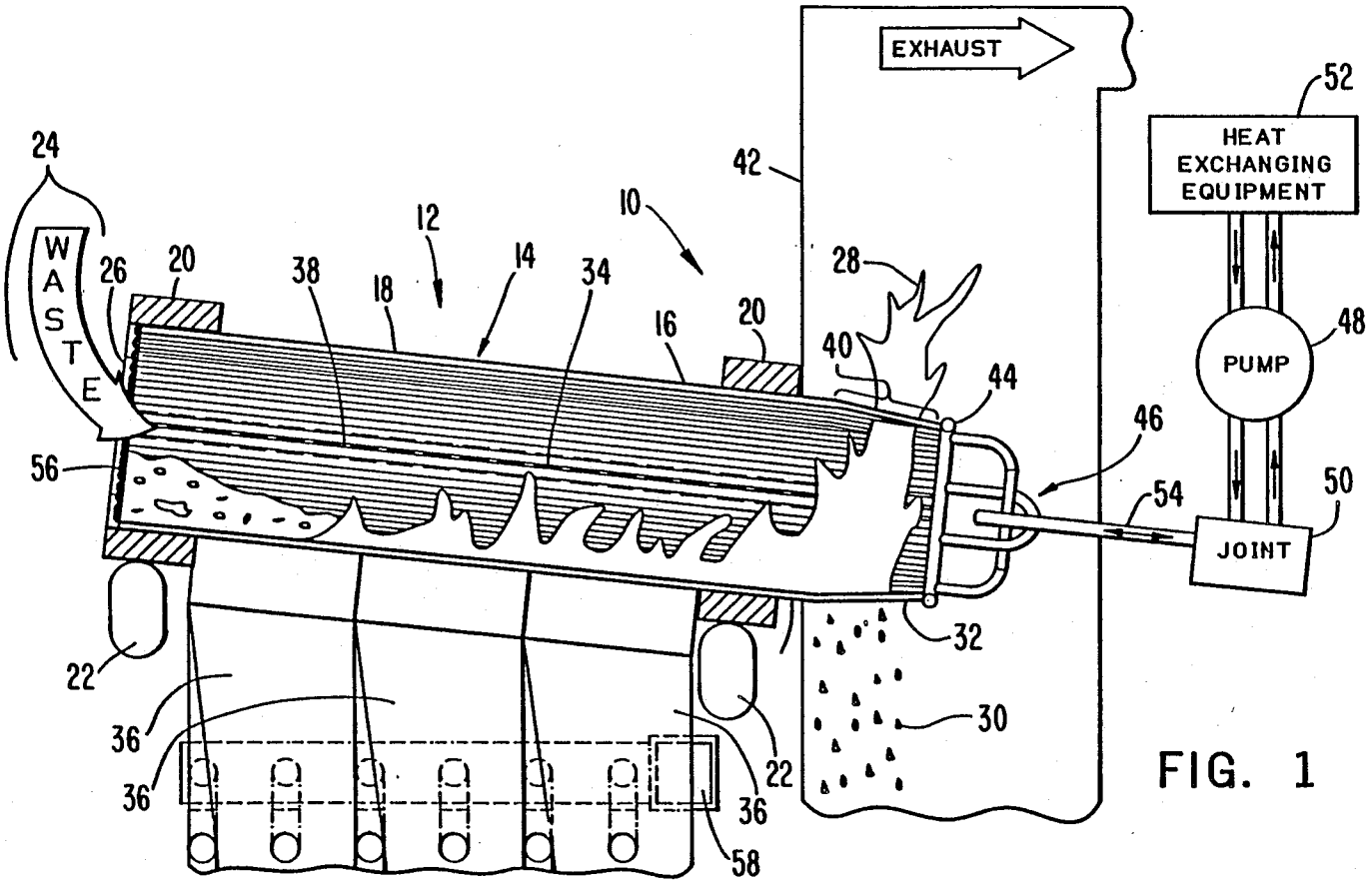
FIG. 1 is a schematic cross-sectional, side elevational view of a waste disposal system employing a rotary combustor according to the present invention.

Referring to the drawings, shown in FIG. 1 is a waste disposal system, generally indicated by the numeral 10, for the combustion of waste materials according to the present invention. The system is useful in the combustion of solid fuel such as municipal waste. The waste disposal system includes a rotary combustor, generally indicated by the numeral 12, having a combustion barrel 14 with generally cylindrical side walls 16 formed of longitudinally extending cooling pipes 18 arranged in spaced axial relationship. The cooling pipes 18 are encircled by, and secured to, bands 20 which in turn are supported by rollers 22. The combustion barrel 14 receives solid waste 24 at an input end 26 and discharges heat 28 and solid combustion products 30, e.g., ash, at an exit end 32. The combustion barrel may be rotated by driving the rollers or by a separate ring gear (not shown) affixed to the barrel and driven by a pinion, as disclosed in U.S. Pat. No. 3,822,651 to Harris et al., incorporated herein by reference.

The combustion barrel has a central axis of rotation which is inclined slightly from the horizontal, proceeding downwardly from the input end to the exit end. Combustion air is forced into the barrel 10 through gas-porous interconnections 34 between adjacent cooling pipes 18 by windboxes 36. The gas-porous interconnections 34 preferably are formed of bar steel perforated by openings 38. The interconnections 34 extend from the input end 26 and along the generally straight axial portions of the pipes 18 to a truncated conical section 40 which is received within a flue 42. No interconnections are included in the conical section 40, in which the cooling pipes 18 extend in a somewhat converging relationship to the exit end 32 of the barrel 14. The lack of interconnections in the conical section permits the flue gas or heat 28 and combustion products 30 to escape more easily from the barrel.

The temperature of cooling pipes 18 is maintained at a desired temperature, i.e., approximately 275° C., by circulating coolant therethrough. The resulting high energy coolant is discharged from the barrel 14 via a ring header 44 and supply pipes 46. The high energy coolant discharged by the supply pipes is circulated by a pump 48 through a rotary joint 50, such as the joint disclosed in Harris et al. U.S. Pat. No. 3,822,651,224, to heat exchanging equipment 52 which returns low energy coolant to the ring header 44 via the pump 48, joint 50 and supply pipes 46. The supply pipes 46 preferably include a double walled or coaxial pipe 54 for connection to the joint 50. The ring header 44 distributes the low energy coolant received from the heat exchanging equipment 52 to a first set of the cooling pipes 18 which transport the coolant the length of the barrel to return means, such as U-tubes 56 at the input end 26 of the barrel. The U-tubes couple the first set of cooling pipes 18 to a second set of the cooling pipes 18 which return the coolant to the ring header 44 to be discharged to the heat exchanging equipment 52. The heat exchanging equipment may include a boiler, a condenser, connection to a steam driven electrical power generating system, etc. (all not shown), as known in the art.

Figure 2:
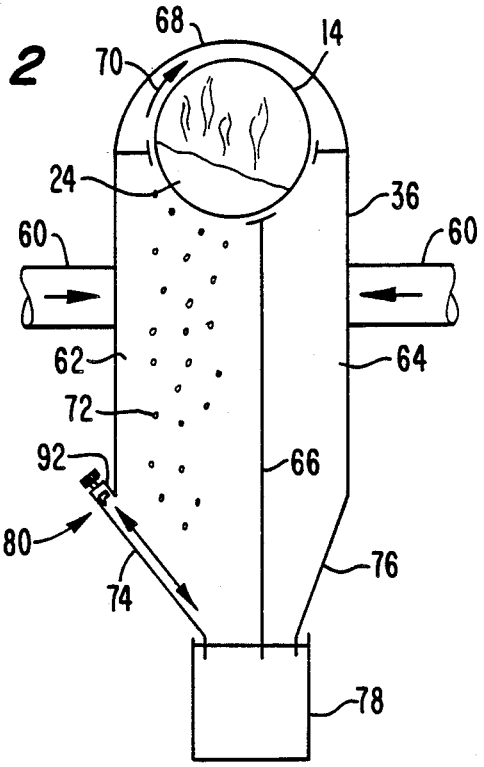
FIG. 2 is a schematic cross-sectional, end view of a rotary combustor according to the present invention showing a scraper in a stored position in a compartment at the outer end of a downwardly sloping bottom surface of a windbox.

Referring to FIGS. 1 and 2, the combustion air is supplied to the combustion barrel by an air duct 58 and the windboxes 36. The windboxes are disposed underneath the combustion barrel 14. Air is transferred from the duct 58 to the windboxes 36 via control ducts 60 shown in FIG. 2. As further shown in FIG. 2, the windboxes are divided into an underfire portion 62 and an overfire portion 64 by partitions 66. Air is supplied separately to both the underfire portion 62 and the overfire portion 64 by the control ducts 60. The air supplied may be preheated by the exhaust from the flue 28 and may be blown by a conventional forced draft fan (not shown).

As illustrated in FIG. 2, the combustion barrel 14 is housed within an enclosure 68 (not illustrated in FIG. 1, for simplicity) which insures that the flue gas exits via the flue 42.

As viewed in FIG. 2 from the exit end 32, the combustion barrel 14 rotates in a clockwise direction as shown by the arrow 70. As a result the waste material 24 is shifted to the left side of the combustion barrel 10. Therefore, above the overfire portion 64 of the windboxes, there are openings 38 which are not covered by the waste material and thus are able to supply large quantities of air to the top of the pile of waste material to support combustion. On the other hand, the underfire portion 62 of the windbox directs air to the base of the waste material to aid in combustion. Ordinarily, the waste material 24 is sufficiently large and irregularly shaped so that a sufficient number of the opening 52 are unblocked above the underfire portion of the windbox, permitting air to penetrate into the waste material in the barrel 14.

During combustion in the combustion barrel, small particulate material such as ashes, and liquids such as molten aluminum, drop through the openings 38 in the interconnections 34. This occurs most often in the underfire portions 62 of the windboxes 36. As shown in FIG. 2, the waste material 24 is primarily situated over the underfire portions and therefore most of the material dropping through the openings 38 lands in these portions. A minor amount of material drops through the openings 38 into the overfire portions 64. The ratio of material falling into the underfire portions as compared to the material falling into the overfire portions is approximately 20:1.

As further shown in FIG. 2, the bottoms 74 and 76 of both the underfire and overfire portions of the windboxes are sloped inwardly and downwardly from the outside edge to facilitate movement of any material dropped into the windboxes to a disposal conveyor system 72.

The temperature of the air in the windbox is less than the melting point of molten aluminum. As a result, the molten aluminum quickly solidifies after dropping through the openings 38 into the windboxes. The major problem occurs at the sloped bottom surface 74 of the underfire portion 62 of each windbox since that portion of the windbox receives most of the material falling through the openings. Accordingly, it is necessary to periodically remove the solidified aluminum in order to maintain efficient operation of the rotary combustor.

Figure 3:
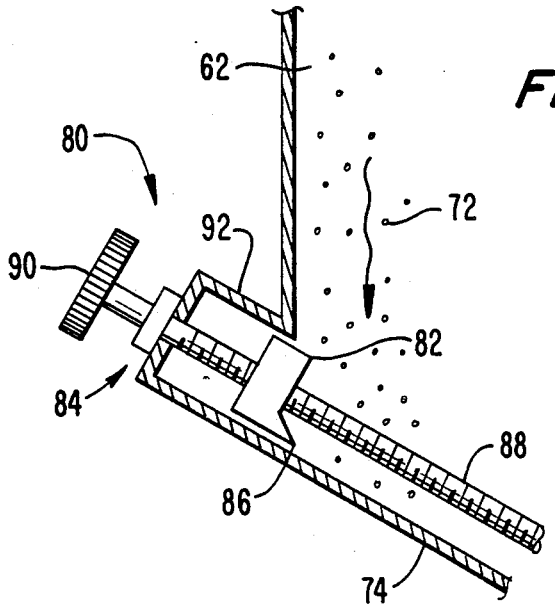
FIG. 3 is an enlarged cross-sectional, side elevational view of the scraper positioned on the bottom sloping surface of the windbox.
Figure 4:
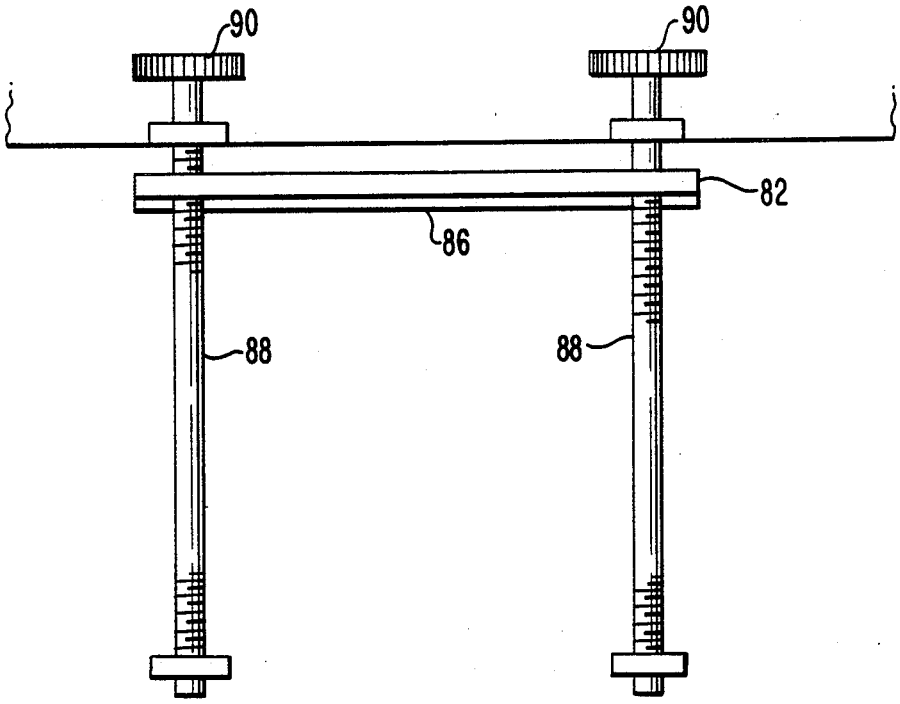
FIG. 4 is an enlarged top view of the scraper and its associated drive mechanism.

According to the present invention, means, generally indicated by the numeral 80, are provided for periodically removing material such as molten aluminum from the bottom sloping inside surfaces of the windboxes. The removal means comprises a scraper 82 and drive means, generally indicated by the numeral 84, for moving the scraper along the bottom sloping surfaces of the windboxes. The scraper 82 is provided on its front with a scraping edge 86 as best shown in FIG. 3. The drive means 84 for the scraper includes one or more rotatable threaded shafts 88, each having a gear 90 at its outer end thereof outside of the windbox. Any suitable power means (not shown), such as a motor, may be used to drivingly rotate each shaft 88. In the embodiment shown in the drawings, the drive means 84 includes two threaded shafts 88. Each shaft is threadably engaged with and through the scraper 82 whereby rotation of the shaft in one direction drives the scraper forwardly while rotation of the shaft in the opposite direction moves the scraper backwardly.

As shown in FIGS. 2 and 3, the underfire portion 62 of each windbox is provided with a compartment 92 at the outer end of sloping bottom surface 74 to accommodate or store the scraper in a storage position outside the main portion of the underfire portion 62 of the windbox when the scraper is not in use. While the embodiment of the invention shown in the drawings only illustrates a scraper on the bottom surface of the underfire portion of the windbox, another scraper could also be provided on the bottom sloping surface of the overfire portion of the windbox if desired.

Figure 5:
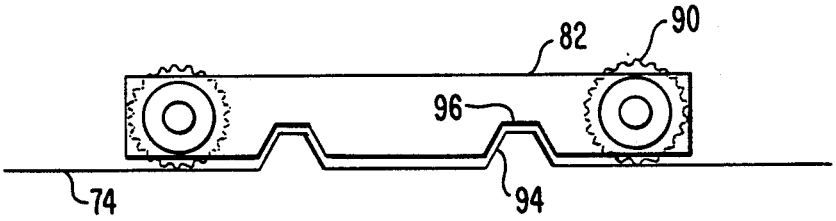
FIG. 5 is an end view of the scraper illustrating another embodiment of the present invention in which the bottom sloping surface of the windbox has ridges thereon and the scraper has corresponding channels to accommodate the ridges.

In another embodiment of the invention as shown in FIG. 5, the bottom sloping surface of the windbox may be provided with one or more ridges 94 and the bottom of the scraper 82 provided with a corresponding channel 96 to accommodate each ridge. Each channel 96 has the same cross-sectional configuration as each ridge 94. In the embodiment shown in FIG. 5, the ridges and channels each have an inverted, truncated V-shaped configuration. This embodiment of the invention is particularly useful in connection with large windboxes since the ridges divide the bottom surface of the windbox into sections which will allow the material solidified on the surface thereof to be broken up into smaller pieces when the scraper moves down the surface. This is important so that large pieces of aluminum are not pushed into the conveyor system to cause the system to jam.

In operation of the present invention, the scraper 82 normally is stored in compartment 92 outside of the main area of the windbox while the rotary combustor is operating. Periodically, as needed, threaded shafts 88 are rotated thereby causing the scraper 82 to move downwardly along the bottom sloping surface of the windbox and scrape off any materials such as solidified aluminum from the surface into the conveyor system for removal. When the scraper reaches the inside end of the bottom sloping surface of the windbox, the rotation of the threaded shafts 88 is then reversed and the scraper is moved back to its storage position.

It is apparent from the above detailed description that many advantageous features are provided by the present invention. A simple mechanical means is provided for periodically scraping material from the bottom sloping surfaces of a windbox to permit continued efficient operation of a rotary combustor without the necessity of shutting down the rotary combustor. In cases of larger installations, the present invention also provides a means for breaking up resolidified molten metal into smaller pieces as the metal is scraped from the bottom surface of the windbox.

Numerous alterations and modifications of the structure herein disclosed will suggest themselves to those skilled in the art. It is to be understood, however, that the present disclosure relates to the preferred embodiments of the invention which is for purposes of illustration only and is not to be construed as a limitation of the invention. All such modifications which do not depart from the spirit of the invention are intended to be included within the scope of the appended claims.

I claim:

1. A rotary combustor comprising:

a combustion barrel;

a windbox disposed underneath said combustion barrel; and means for removing material from an inside surface of said windbox, said means comprising:

a scraper mounted inside said windbox for movement along said surface; and drive means for moving said scraper along said surface.

2. A rotary combustor as defined in claim 1, wherein said drive means comprises a rotatable shaft threadably engaged with said scraper whereby rotation of said shaft moves said scraper along said surface.

3. A rotary combustor as defined in claim 1, wherein said surface is provided with at least one ridge thereon and the bottom of said scraper is provided with a channel having the same general cross-sectional configuration as said ridge whereby said ridge is accommodated in said channel when said scraper is on said surface.

4. A rotary combustor as defined in claim 1, wherein said windbox has a compartment at the outer end of said surface, extending outwardly from a side wall of said windbox to accommodate said scraper when it is not in use.

5. A rotary combustor as defined in claim 1, wherein said surface constitutes a downwardly and inwardly sloping bottom surface of said windbox.

6. A rotary combustor comprising:

a combustion barrel;

a windbox disposed underneath said combustion barrel;

means for removing material from a downwardly and inwardly sloping inside bottom surface of said windbox, said means comprising:

a scraper mounted inside said windbox for movement along said surface; and drive means for moving said scraper comprised of a rotatable shaft threadably engaged with said scraper whereby rotation of said shaft moves said scraper along said surface; and wherein said windbox has a compartment at the outer end of said surface extending outwardly from a side wall of said windbox to accommodate said scraper when it is not in use.

7. A rotary combustor as defined in claim 6, wherein said surface is provided with at least one ridge thereon and the bottom of said scraper is provided with a channel having the same general cross-sectional configuration as said ridge whereby said ridge is accommodated in said channel when said scraper is on said surface.

* * * * *